US005449232A

United States Patent [19]

Westbrooks, Jr. et al.

[11] Patent Number: 5,449,232

[45] Date of Patent: Sep. 12, 1995

[54] INSULATING BARRIER FOR COMBINED HOT/COLD FOOD SERVICE CART

[75] Inventors: John W. Westbrooks, Jr., Christiana; Sara C. Hurt, Nashville; Anthony C. Grotefeld, Murfreesboro, all of Tenn.; Joseph D. Miller, Picayune, Miss.

[73] Assignee: Standex International Corporation, Murfreesboro, Tenn.

[21] Appl. No.: 213,412

[22] Filed: Mar. 15, 1994

[51] Int. Cl.[6] ..... A47B 81/04; F25D 25/02

[52] U.S. Cl. ..... 312/410; 312/236; 312/296; 312/403; 165/919; 165/12; 165/2; 165/48.1; 165/61; 165/64; 219/386; 219/400

[58] Field of Search ..... 312/410, 296, 401, 403, 312/404, 405, 408; 165/918, 919; 99/483; 49/483.1

[56] —References Cited

U.S. PATENT DOCUMENTS

| | | | |
|---|---|---|---|
| 3,160,452 | 12/1964 | Rothman | 312/403 X |
| 3,199,579 | 8/1965 | Foster et al. | 165/919 X |
| 3,222,114 | 12/1965 | Stentz | 312/403 |
| 3,240,544 | 3/1966 | Heckel, Jr. et al. | 312/403 |
| 3,255,812 | 6/1966 | Bayane et al. | 165/919 X |
| 3,275,393 | 9/1966 | Stentz et al. | 312/403 |
| 3,291,546 | 12/1966 | Traycoff | 312/403 |
| 3,311,434 | 3/1967 | Dyer et al. | 312/296 X |
| 3,908,749 | 9/1975 | Williams | 165/919 X |
| 3,965,969 | 6/1976 | Williamson . | |
| 4,005,745 | 2/1977 | Colato et al. . | |
| 4,019,022 | 4/1977 | Selder et al. . | |
| 4,068,115 | 1/1978 | Mack et al. . | |
| 4,087,142 | 5/1978 | Aumack . | |
| 4,093,041 | 6/1978 | Davis et al. . | |
| 4,103,736 | 8/1978 | Colato et al. . | |
| 4,194,109 | 3/1980 | Springer . | |
| 4,203,486 | 5/1980 | Rubbright et al. . | |
| 4,235,282 | 11/1980 | de Filippis et al. . | |
| 4,254,824 | 3/1981 | Springer . | |
| 4,285,391 | 8/1981 | Bourner . | |
| 4,316,078 | 2/1982 | Mack et al. . | |
| 4,323,110 | 4/1982 | Rubbright et al. . | |
| 4,384,191 | 5/1983 | Guibert . | |
| 4,881,590 | 11/1989 | Meier . | |
| 5,069,273 | 12/1991 | O'Hearne | 99/483 X |
| 5,093,556 | 3/1992 | Oelfke . | |
| 5,159,973 | 11/1992 | Pennington et al. | 165/919 X |

*Primary Examiner*—Jose V. Chen
*Assistant Examiner*—Rodney B. White
*Attorney, Agent, or Firm*—Luedeka, Neely & Graham

[57] ABSTRACT

An improved thermal curtain for separating a food service cart into hot and cold regions is disclosed. The thermal curtain is composed of composite foam structural elements which have enhanced insulating capability, toughness and the ability to provide structural support for food service trays placed thereon. The thermal curtain is composed of a plurality of vertically superposed tray support/thermal barrier sections which attach to a support bracket which further attaches to the back of the food service cart. The upper portion of the support/barrier is adapted to provide a tray support and conforms to the design of the food service tray to minimize migration of heated or cold air to the opposite compartment. The lower edge of the support/barrier section is composed of a blade seal floating in a retention channel which allows vertical movement of the seal. When a tray is inserted, the blade seal travels upward so that the tray may be inserted and the lower edge of the blade seal contacts the upper edge of the tray. When a tray is removed, the blade seal lowers into contact with the upper edge of the next lower support/barrier to form a thermal seal.

15 Claims, 3 Drawing Sheets

INSULATING BARRIER FOR COMBINED HOT/COLD FOOD SERVICE CART

FIELD OF THE INVENTION

This invention relates to the field of food service carts having hot and cold storage areas and particularly to an improved insulating thermal curtain for use in separating hot and cold storage areas in a combined hot/cold food service cart.

BACKGROUND OF THE INVENTION

In general institutional food service settings, there is a substantial problem of food service efficiency and maintenance of food quality. In large hospital and other institutional settings a large number of meals need to be served in a relatively short time period. It can be appreciated that in order to comply with time constraints, the meals need to be prepared well ahead of time and assembled onto serving trays for easy dispensing. However, a meal that is held on a serving tray for several hours may degrade.

For example, if the items to be served hot are not maintained hot they are frequently unappetizing. However, heating the entire meal is impractical if there are cold items such as fruits, salads or cold beverages. Furthermore, quality considerations are not the only worry. Once heated, food items need to be maintained at minimum temperatures to deter spoilage while other items need to be maintained in a refrigerated state for similar reasons. Yet, maintaining these items in separate containers until serving increases inefficiency and delays in food service, and requires increased manpower during service.

One solution to this problem is described in U.S. Pat. No. 3,205,033, entitled Tray Support and Thermal Wall for a Hot and Cold Food Service Cart, awarded to B. E. Stentz, incorporated herein by reference. The solution described in the Stentz patent is to provide a food service cart having both hot and cold compartments. The hot and cold compartments are separated by a thermal curtain which includes a plurality of tray supports which also form a part of the thermal curtain. The top portion of each tray support provides a rib which mates to the bottom of a food service tray, in the approximate center of the tray. The bottom portion of the tray support terminates in a flexible flap which contacts either a food service tray placed below the flap or the rib of the next lower tray support. Thus, by placing cold food items on one side of the tray and hot food items on the opposite side, the tray may be placed on a tray support with the flap of the next higher tray support providing a thermal curtain between the refrigerated and heated portions of the cart. Likewise, the mating of the rib of a tray support to the underside of the tray provides a similar thermal barrier in the underside of the tray. In this manner, individual meals may be completely assembled well before service, and the food is maintained in the appropriate hot or cold conditions.

However, the device of the Stentz patent had several drawbacks, the primary being that the thermal curtain described therein was not as efficient an insulator as would be desirable. As a result, the heating elements and refrigeration compressors maintained a relatively heavy duty cycle in order to maintain the hot and cold compartments at the desired temperatures. This fact resulted in relatively high power consumption and shorter heating element and compressor life.

Furthermore, the thermal curtain of Stentz, particularly the neoprene flap, was subject to deterioration due to the sharp thermal differentiation on either side of the flap. Furthermore, the flap did not provide a very effective seal with the food service tray so that there was convection and leakage at the interface.

It is therefore an object of the present invention to provide an improved hot and cold food service cart.

It is yet a further object of the present invention to provide a hot and cold food service cart having a thermal seal made of material having improved insulating characteristics and durability.

It is yet a further object of the present invention to provide a thermal seal for a food service cart having an improved seal/tray interface coupled with easy insertion and removal of food service trays.

SUMMARY OF THE INVENTION

The above and further objects are achieved in a food service cart made in accordance with a preferred embodiment of the present invention. In the preferred embodiment, an improved thermal curtain for a food service cart having an interior compartment and a door is provided for separating the interior into at least two thermally isolated temperature zones. In the preferred embodiment, a support structure is provided for supporting the thermal curtain and for ultimately supporting food service trays to be placed therein.

In the preferred embodiment, the thermal curtain is constructed of thermal barrier/tray supports structurally attached to the support structure. The thermal barrier/tray supports are preferably constructed of a urethane composite foam having sufficient structural rigidity to provide the necessary support for the food service trays while providing good thermal insulating properties. The preferred foam is BX-445.

The thermal barrier/tray supports preferably have a top edge having tapered corners and a channel extending along the tip edge in the approximate center of the support. The bottom edge of the support is preferably formed into a retention channel. Attachment points, such as threaded metal inserts, are preferably provided in the support and extend to the rear edge of the thermal barrier/support for attachment to the support structure and additional structural rigidity. In one embodiment, the foam is mixed and cured so that it forms a rind of suitable thickness in order to increase the hardness of the thermal barrier/tray support sections.

In the preferred embodiment, a plurality of blade seals are provided. Generally, the blade seals are constructed of the same material as the thermal barrier/tray supports. The top edge of the blade seals are retained in the retention channel of the thermal barrier/tray supports. The retention channel and the top of the blade seal are configured so that the top of the blade seal may slide vertically within the retention channel; however, the retention channel is formed so that the blade seal cannot normally exit from the retention channel. The bottom edge of the blade seal is preferably shaped to mate with the channel in the top edge of the thermal barrier/tray supports so as to provide a thermal seal in the absence of a food service tray while forming an efficient seal with a food service tray when a tray is in place.

In the preferred embodiment, a plurality of specially adapted food service trays are provided to support food items to be served while still providing an efficient seal. The food service tray is generally divided into hot and cold food item sections separated by a seal section which contacts the thermal barrier/tray support. The underside of the seal section preferably has channels and a ridge which mate with the bevelled corners channel of the top edge of the thermal barrier/tray support to provide a seal. The top edge of the seal section is preferably flat so as to provide good contact with the bottom of a blade seal and thereby form a thermal seal.

In the preferred embodiment, a roof seal, corresponding to the lower portion of a thermal barrier/tray support and blade seal combination is provided to complete the top of the thermal curtain and a seal between the roof of the cart and the uppermost food service tray of the thermal curtain. Similarly, a floor seal is provided corresponding to the top portion of a thermal barrier/-tray support to provide a seal between the floor and the lowermost food service tray or blade seal.

BRIEF DESCRIPTION OF THE DRAWINGS

The above and further features may be best understood with reference to the following detailed description and the drawings in which.

FIG. *7a* is a simplified view of a thermal curtain with food service trays removed; and FIG. *7b* is a simplified view of a thermal curtain with food service trays in place.

DETAILED DESCRIPTION OF A PREFERRED EMBODIMENT

Figure 1:
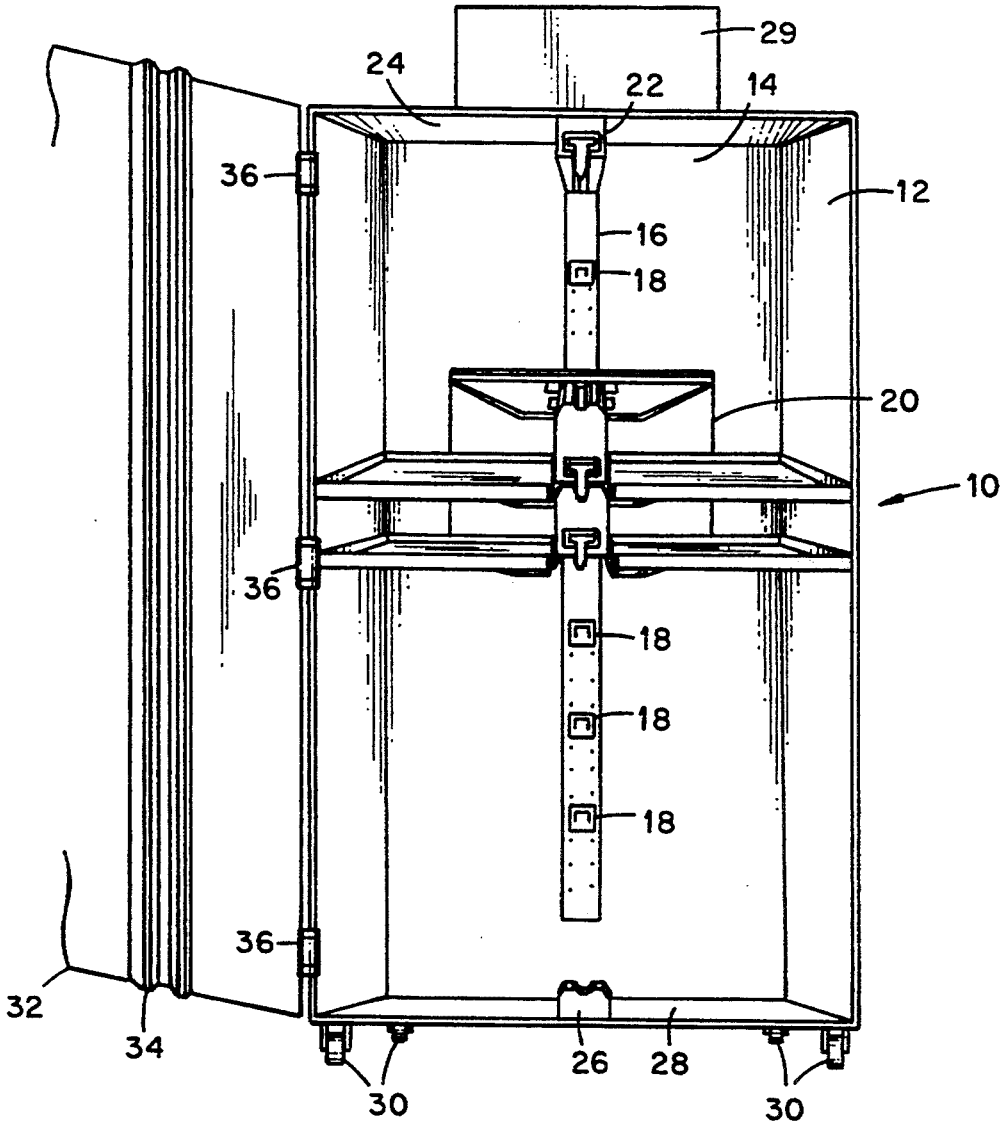
FIG. 1 is a front view of an open food service cart with a portion of the thermal curtain in place.

Referring now to the drawings in which like reference numerals indicate like or corresponding features, there is shown in FIG. 1 a food service cart 10. This cart 10 is of the type in which there are both heating elements and refrigeration means for heating the air on one side of the cart and cooling the air on the other side of the cart (as by heating elements located within the walls of the hot side of the cart and refrigerated air being introduced on the cold side of the cart). However, the main body of the cart 10 defines a single interior compartment 12. It should be noted that the cart 10 of FIG. 1 is shown partially assembled; only one section of the thermal curtain and tray support structures is shown in place in the cart 10 in FIG. 1 so that the features of the cart 10 may be described. It should be recognized that a fully assembled cart 10 would have a full set of thermal barrier/tray support units and, preferably, would support at least twelve food service trays.

Along the back wall 14 of the interior compartment 12 is mounted a support strip 16. At intervals along the support strip 16, support hooks 18 are mounted. The support hooks 18 support thermal barrier/tray support units 20 in a manner which will be more fully described hereinafter. At the top of the interior compartment 12, thermal curtain top section 22 is mounted to the roof 24 of the compartment with bolts or screws. Similarly, thermal curtain bottom section 26 is secured to the floor 28 of the compartment. Top section 22 is basically identical to the lower portion of the thermal barrier/tray support units 20 to be described later and bottom section is basically identical to the top portion of the units 20. In ways known to the art, a refrigeration compressor unit 29 is located on the top of the cart 10 and the cart may be supported by casters 30 to facilitate its movement for service of the food.

The door 32 of the cart 10 is provided with a thermal barrier strip 34 designed to mate with the end of the thermal barrier/tray support units 20 separating the hot and cold sides of the cart 10. As will be described more fully later, this strip 34 has a cross section designed to mate with the front edge of the units 20 in order to prevent mixing of the hot and cold air by convection between the front edge of the units 20 and the door 32. Preferably, the door 32 has a perimeter seal (not shown), constructed in ways well known in the art, to isolate the interior of the cart from the external environment. The door is mounted on hinges 36 and provided with a latch (not shown) for normal opening and closing.

Figure 2:
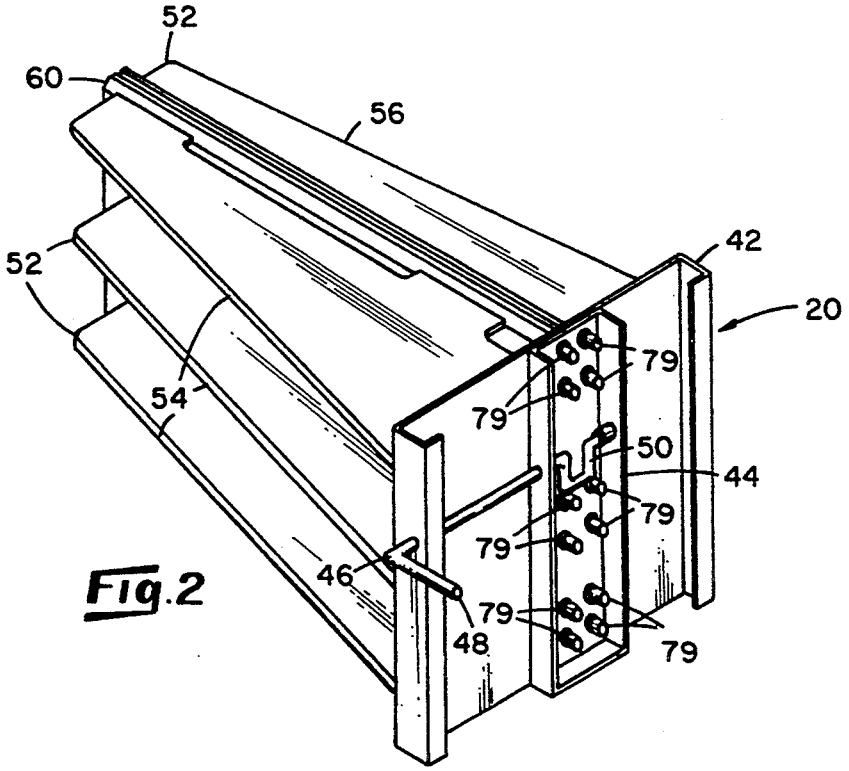
FIG. 2 is a rear view of a thermal barrier/tray support section, removed from the cart.

Referring now to FIG. 2, the design and construction of a thermal barrier/tray support unit 20 is shown. The unit 20 is constructed of a structural base plate 42. This base plate 42 is preferably stainless steel both for structural rigidity and for easy cleaning in the food service environment. Provided on the base plate 42 are guide flanges 44 which mate with the edges of support strip 16 located on the back wall 14 of the cart 10 (shown in FIG. 1). These flanges 44 provide lateral stability to the curtain unit 20 and base plate 42 when mounted in the cart 10. A locking bar 46 extends through the flanges 44 and through one edge of the base plate 42 and terminates in a handle 48. The bar 46 also includes a loop 50 which is located between the flanges 44. The handle 48 is rotatable so that the loop 50 may be moved between extended and locked positions. When extended, the loop 50 of the locking bar 46 may be placed over support hook 18 on the support strip 16 of the cart 10 to mount the unit 20. The handle 48 may then be rotated to the locked position. When the handle 48 is rotated to the locked position, the loop 50 is rotated so as to be closer to the base plate 42; this action draws the base plate 42 into contact with the rear wall 14 of the interior compartment 12 and the flanges 44 into position along the support strip 16. Thus, the unit 20 becomes rigidly supported in the cart 10 so that the remaining parts of the unit 20 are properly supported and positioned and food services trays may be loaded. The cart may be configured to support as many units 20 as desirable (such as 4 for 12 tray carts or 8 for 24 tray carts). For simplicity a twelve tray cart will be shown throughout, which utilizes four thermal barrier/tray support units 20.

In a preferred embodiment, three tapered support wings 52 are mounted on the base plate 42. These wings 52 provide cantilevered support for the food service trays and are preferably made of stainless steel. These wings 52 are made of mirror image left wings 54 and right wings 56 which are independently attached to the base plate 42. The left and right wings 54, 56 are separated by thermal curtain sections 60 which are likewise attached to the base plate 42.

Figure 3:
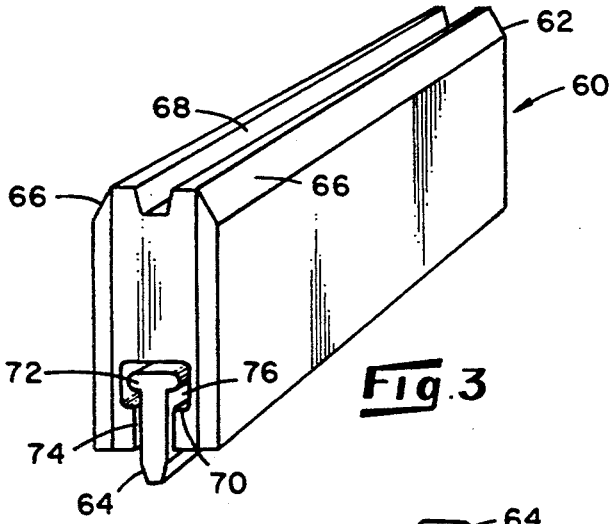
FIG. 3 is a front perspective view of a thermal barrier/tray support and blade seal.

Referring now the FIG. 3, the construction of a thermal curtain section 60 may be described. The thermal curtain section 60 is preferably made of composite foam (which will be described in greater detail hereinafter).

The thermal curtain is preferably made by a molding process in which barrier support 62 and blade seal 64 are foamed separately. As can be seen in FIG. 3, the top section of the barrier support 62 has tapered side edges 66 and a channel 68 extending longitudinally between the side edges 66. The lower portion of the barrier support consists of an elongate channel 70 preferably having a squared mushroom shape. The blade seal 64 preferably has a t-shaped cross section with the cross bar 72 of the blade seal 64 being larger than the narrow portion 74 of the channel 70. However, the wide portion 76 of the channel 70 should preferably be of a size to allow vertical movement of the blade seal 64.

Figure 4:
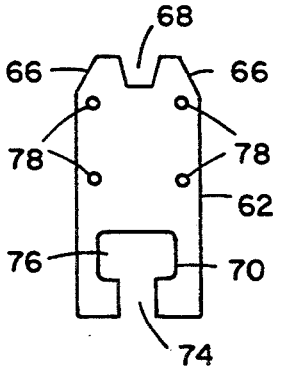
FIG. 4 is a cross-sectional view of a thermal barrier/-tray support.

As can be seen with reference to FIG. 4, the barrier support 62 is preferably tapped by four threaded inserts 78 which extend from the back edge of the barrier support 62 well into the barrier support 62. These inserts 78 preferably receive a mounting bolt made of stainless steel. The inserts 78 and mounting bolts provide a means for attaching the barrier support 62 to the base plate 42 as by a bolt extending through the base plate 42 at connection points 79. Additionally, the inserts 78 provide additional structural rigidity to the thermal curtain section 60. These inserts 78 may be positioned in the mold prior to introduction of the composite foam of the barrier support 62 or may be inserted after the barrier support 62 has been removed from the mold.

Figure 5:
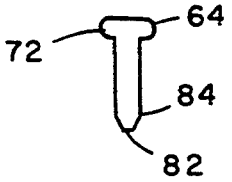
FIG. 5 is a cross-sectional view of a blade seal.

Referring now to FIG. 5, additional features of the blade seal 64 may be described. The blade seal 64 and tray 80 (FIGS. 1 and *7a*) have matching cam lobes 82 in order to improve the thermal seal formed therebetween. Further a leading edge chamfer 84 is cut to one side of the lower portion of the blade seal 64 where the blade seal will initially contact a tray being inserted. This chamfer 84 will provide a leading edge on the blade seal 64 so that when a tray 80 is being inserted, the blade seal 64 will ride up over the edge of the tray 80 facilitating insertion of the tray. The chamfer 84 is asymmetrical so that it does not provide a gap in the seal between the tray 80 and the blade seal 64 through which air could pass.

Referring again to FIG. 2, it can be seen that a thermal barrier/tray support unit 20 is constructed by attaching three sets of thermal curtains 60, and wings 52 to the base plate 42. Then the constructed units 20 may be mounted in the cart 10 as previously described to provide a cart ready to be used.

Figure 7A:
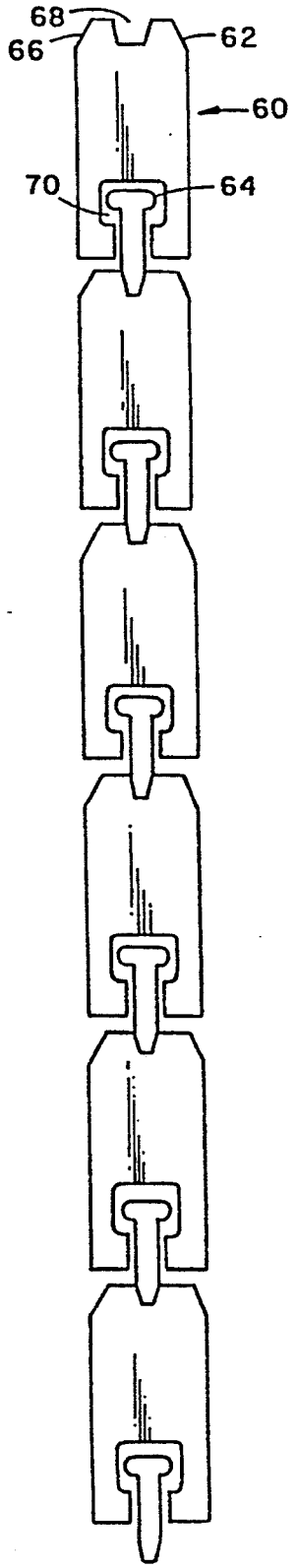
Figure 7B:
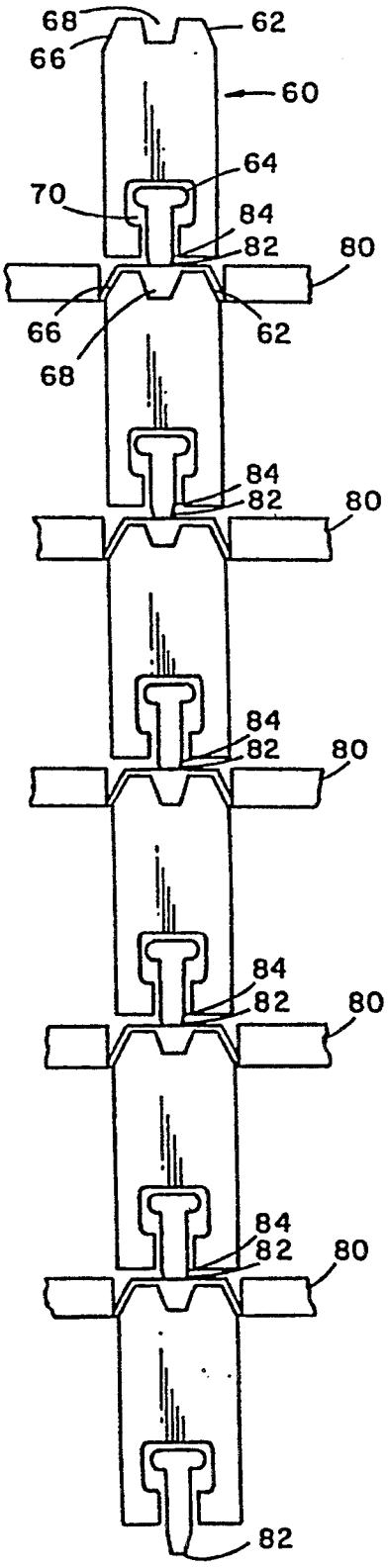

In use, a specially designed food service tray would be used. Referring now to FIG. 7b, a portion of the tray 80 is shown in cross section in place. The lower portion of the middle of the tray 80 is provided with a shape designed to mate with the tapered side edges 66 and channel 68 of the barrier support 62 in order to minimize mixing of the hot air on one side of the cart with that on the other. With respect to the top edge of the tray 80, when the tray is in place in the cart 10, the blade seal 64 of the barrier curtain 60 above the tray 80 contacts the top edge of the tray 80 forming a barrier as well. Referring now to FIGS. *7a* and *7b* a simplified cross section of a cart with all thermal barrier/tray support units 20 in place is shown. In FIG. *7a,* the cart 10 is shown with the trays 80 removed. As can be seen, when the trays 80 are not in place, the blade seal 64 drops within channel 70 of barrier support 62 so that the blade peal 64 mates with the channel 68 in the top of the next lower barrier support 62. However, when a tray 80 is inserted, blade seal 64 is lifted within the channel 70, until the lower edge of the 64 is supported on the tray 80, as can be seen in FIG. *7b*. Thus, regardless of whether the trays 80 are in place or not, an effective thermal barrier is provided by thermal curtain 60. This allows for the pre-heating and cooling of the cart prior to introduction of the food service trays 80.

It is anticipated-that a variety of urethane foam systems may be used, in connection with a properly prepared mold system to build the barrier support 62 and the blade seal 64. However, after extensive testing, it has been determined that the best overall urethane foam system is the BX-445 urethane foam system available from Stepan Chemical Company. This foam system is appropriate for several reasons. Of several other foam systems tested, only the BX-445 system released from the molds satisfactorily and maintained the insulating and durability requirements required by this type of application.

Any foam system would have to meet minimum requirements of maintaining contrasting temperatures, on either side of the thermal curtain 60, of 250°–275° F. and 34°–40° F. for 2 hours and/or 140°–175° F. and 34°–40° F. for 8 hours. Additionally, environmental conditions require that the material remain durable despite the sharp temperature differential on either side of the curtain 60 in conditions of 80–100% relative humidity for long periods of time.

Initially, the BX-445 was processed in the molds per manufacturers instructions, in ways well known in the art; however, due to the fast reactivity of the system, there was insufficient time to close the mold when the mold was at a temperature of 105° F. and the components were at 77° F. Optimally, the molds were maintained near 70° F., as were the A and B components of the foam system. These conditions allow sufficient time for mixing, pouring the material and the placing and securing of the mold end cap.

In order to enhance the characteristics of the rind which forms on the exterior surface of the foam, the A/B ratio of the system was changed from a ratio of 1.77:1 to 1.5:1 to decrease the friability of the skin of the part and the initial cure temperature was held at 300° F. for two hours and cooled to below 100° F. before demolding. These conditions result in a part with a shore D hardness of 55–60, which provides improved rind characteristics and durability. Finally, in order to differentiate the parts, Ferro F-6331 black pigment was added in an amount of 2.5% by weight for the barrier support 62 and 0.31% by weight for the blade seal 64. It is anticipated that the mix ratio could be further refined and cure temperatures as high as 375° F. would be appropriate in preparing these parts.

Figure 6:
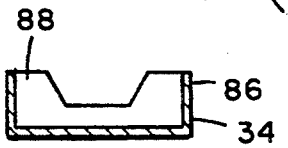
FIG. 6 is a cross-sectional view of a door seal strip.

A final feature is a door seal strip 34 which mates with the leading edges of the thermal curtain 60 when the door is closed, thus preventing leakage around the front of the thermal curtain 60 between the leading edge and the door. A cross section of the door seal strip 34 is shown in FIG. 6. As can be seen, the door seal strip 34 is made of a mounting support 86 in which is placed a seal material 88. Preferably the seal material 88 is formed in the shape of a tapered channel having a width corresponding to the width of the thermal curtain 60. The seal material could be any of a variety of materials known in the art, but must have good durability, insulating characteristics and be pliable so as to form a good seal with the thermal curtain 60. The BX-445 foam system previously discussed is an example of one such material.

When constructed in accordance with the above teaching, the improved barrier seal system for use in a hot/cold food service cart provides many advantages and improvements over the prior art designs. Initially, the foam system provides much better insulating characteristics than any prior art systems. Thus, the heating and cooling components of the system have a much reduced duty cycle. This increases the life span of the components most subject to failure and further results in substantial energy saving. Especially since these types of food service systems are often used in hospital settings, such savings would be particularly beneficial in that they help to reduce the operating expenses in this area of medical care.

Furthermore, such improved thermal isolation between the hot and cold areas of the cart results in an improvement in food quality. By greater thermal isolation, the food in each area of the cart may be maintained at a temperature more closely approaching the ideal serving temperature. In this manner, the food is much more appetizing since the warming of cold items and cooling of hot items is minimized.

The above description of a preferred embodiment is provided for the purposes of illustration and not limitation. It is anticipated that the preferred embodiment is capable of numerous substitutions, modifications or deletions without departing from the scope of the invention as set forth in the claims. For example, while it was described that the BX-445 foam system is preferred, there are many other foam systems which may be suitable. Additionally, while the foam parts were described as being injection molded, any other construction technique may be used, such as extrusion.

We claim:

1. An improved tray support and thermal curtain for use in a food service cart having an interior compartment and a door for supporting a plurality of food service trays and for dividing the interior of the cart in to at least two thermally isolated zones comprising:

support means for supporting said tray support and thermal curtain;

a plurality of thermal tray support/thermal barrier sections (support/barrier sections) attached in vertically superposed alignment to said support means, each of said support/barrier sections further comprising top and bottom portions having front and rear edges extending from said support means at said rear edge to the front of the interior of the cart at said front edge, said rear edge incorporating attachment means for securing said support/barrier section to said support means, said bottom portion including a retention channel having a shape, said retention channel extending along the length of said bottom portion;

a plurality of blade seals having front, rear, top and bottom edges and having a length corresponding to the length of said support/barrier section, said top edge having a shaped portion complimentary to said shape of retention channel adapted to be retained in a vertically movable configuration in said retention channel of said support/barrier section and said bottom edge adapted to contact said top portion of said support/barrier section to form a thermal seal between said bottom edge of said blade seal and said top portion of said support/barrier section;

said support/barrier sections and said blade seals formed of a thermally insulating material.

2. The cart of claim 1 further comprising a plurality of food service trays divided into hot and cold zones, said zones separated by a seal section, said seal section having top and bottom surfaces, said bottom surface extending from the front of said tray to the rear of said tray and adapted to mate with the top edge of said support/barrier section to form a thermal seal when said tray is in place on said support/barrier section, said top of said blade seal moving vertically within said retention channel of said support/barrier section upon insertion of a food service tray into said cart and said lower edge of said blade seal contacting the top surface of said seal section of said food service tray to form a thermal seal.

3. The cart of claim 1 wherein said support/barrier sections and said blade seals are constructed of a urethane foam.

4. The cart of claim 1 wherein said support/barrier sections and said blade seals are constructed of BX-445 composite urethane foam.

5. The cart of claim 1 wherein said support means further comprises:

a support strip structurally attached to the rear wall of said cart, said support strip extending vertically substantially from top to bottom of the cart;

a plurality of hooks disposed at intervals along said support strip;

a plurality of back plates constructed of rigid sheet material, said back plates adapted and constructed to provide an attachment point for said support/barrier sections; and locking means for releasably attaching said back plates to said hooks on said support strip.

6. The cart of claim 1 further comprising a plurality of tray support wings associated with each of said plurality of support/barrier sections and attached to said support means, said support wings constructed of rigid sheet material and placed to allow the bottom of said food service trays to rest upon said support wings.

7. The cart of claim 1 further comprising a door seal strip extending from the top of the cart door to the bottom of said cart door, opposite said thermal curtain when the cart door is closed, said door seal strip having a cross-sectional shape corresponding to the front edge of said plurality of support/barrier sections and blade seals.

8. The cart of claim 1 further comprising a roof seal having a structure corresponding to the bottom edge of said support/barrier sections and including a blade seal, attached to the ceiling of said cart, forming a thermal seal with the topmost of said support/barrier sections or food service trays.

9. The cart if of claim 1 further comprising a floor seal having a structure corresponding to the top edge of said support/barrier sections for forming a thermal seal with the lowermost of said blade seals or food service trays.

10. An improved tray support and thermal curtain for use in a food service cart having an interior compartment and a door for supporting a plurality of food service trays and for dividing the interior of the cart in to at least two thermally isolated zones comprising:

support means for supporting said tray support and thermal curtain;

a plurality of tray support/thermal barrier sections (support/barrier sections) attached in vertically superposed alignment to said support means, each of said support/barrier sections further comprising top and bottom portions having front and rear edges extending from said support means at said rear edge to the front of the interior of the cart at said front edge, said top portion having a top edge including bevelled corners extending along said top edge for the length of said support/barrier section and a reception channel, substantially in the center of said top edge, extending along the length of said top edge, said rear edge incorporating attachment means for securing said support/barrier section to said support means, said bottom portion including a retention channel extending along the length of said bottom portion;

a plurality of blade seals having front, rear, top and bottom edges and having a length corresponding to the length of said support/barrier section, said top edge adapted to be retained in a vertically movable configuration by said retention channel of said support/barrier section and said bottom edge having cam lobes adapted to mate with said reception channel in said support/barrier section to form a thermal seal between said bottom edge of said blade seal and said support/barrier section;

a plurality of food service trays divided into hot and cold zones, said zones separated by a seal section, said seal section having top and bottom surfaces, said bottom surface having channels and a rib extending from the front of said tray to the rear of said tray and adapted to mate with the tapered corners and reception channel of said top portion of said support/barrier section to form a thermal seal when said tray is in place on said support/barrier section, said top of said blade seal moving vertically within said reception channel of said support/barrier section upon insertion of a food service tray into said cart and said lower edge of said blade seal contacting the top surface of said seal section of said food service tray to form a thermal seal;

a roof seal having a structure corresponding to the bottom portion of said support/barrier sections and including a blade seal, attached to the ceiling of said cart, forming a thermal seal with the topmost of said support/barrier sections or food service trays;

a floor seal having a structure corresponding to the top portion of said support/barrier sections forming a thermal seal with the lowermost of said blade seals or food service trays;

a door seal strip extending from the top of the cart door to the bottom of said cart door, opposite said thermal curtain when the cart door is closed, said door seal strip having a cross-sectional shape corresponding to the front edge of said plurality of support/barrier sections and blade seals; and said tray support/barrier sections and said blade seals formed of a thermally insulating material.

11. The cart of claim 10 wherein said support/barrier sections and said blade seals are constructed of a urethane foam.

12. The cart of claim 10 wherein said support/barrier sections and said blade seals are constructed of BX-445 composite urethane foam.

13. The cart of claim 10 wherein said support means further comprises:

a support strip structurally attached to the rear wall of said cart, said support strip extending vertically substantially from top to bottom of the cart;

a plurality of hooks disposed at intervals along said support strip;

a plurality of back plates constructed of rigid sheet material, said back plates adapted and constructed to provide an attachment point for said support-/barrier sections; and locking means for releasably attaching said back plates to said hooks on said support strip.

14. The cart of claim 10 further comprising a plurality of tray support wings associated with each of said plurality of support/barrier sections and attached to said support means, said support wings constructed of rigid sheet material and placed to allow the bottom of said food service trays to rest upon said support wings.

15. An improved tray support and thermal curtain for use in a food service cart having an interior compartment and a door for supporting a plurality of food service trays and for dividing the interior of the cart in to at least two thermally isolated zones comprising:

support means for supporting said tray support and thermal curtain;

a plurality of tray support/thermal barrier sections (support/barrier sections) attached in vertically superposed alignment to said support means, each of said support/barrier sections further comprising top and bottom portions having front and rear edges extending from said support means at said rear edge to the front of the interior of the cart at said front edge, said top portion having a top edge including bevelled corners extending along said top edge for the length of said support/barrier section and a reception channel, substantially in the center of said top edge, extending along the length of said top edge, said rear edge incorporating attachment means for securing said support/barrier section to said support means, said bottom portion including a retention channel extending along the length of said bottom portion;

a plurality of blade seals having front, rear, top and bottom edges and having a length corresponding to the length of said support/barrier section, said top edge adapted to be retained in a vertically movable configuration by said retention channel of said support/barrier section and said bottom edge having cam lobes adapted to mate with said reception channel in said support/barrier section to form a thermal seal between said bottom edge of said blade seal and said support/barrier section;

said support means further comprising:

a support strip structurally attached to the rear wall of said cart, said support strip extending vertically substantially from top to bottom of the cart;

a plurality of hooks disposed at intervals along said support strip;

a plurality of back plates constructed of rigid sheet material, said back plates adapted and constructed to provide an attachment point for said support-/barrier sections; and locking means for releasably attaching said back plates to said hooks on said support strip;

a plurality of food service trays divided into hot and cold zones, said zones separated by a seal section, said seal section having top and bottom surfaces, said bottom surface having channels and a rib extending from the front of said tray to the rear of said tray and adapted to mate with the tapered corners and reception channel of said top portion of said support/barrier section to form a thermal seal when said tray is in place on said support/barrier section, said top of said blade seal moving vertically within said reception channel of said support/barrier section upon insertion of a food service tray into said cart and said lower edge of said blade seal contacting the top surface of said seal section of said food service tray to form a thermal seal;

a plurality of tray support wings associated with each of said plurality of support/barrier sections and attached to said support means, said support wings constructed of rigid sheet material and placed to allow the bottom of said food service trays to rest upon said support wings;

a roof seal having a structure corresponding to the bottom portion of said support/barrier sections and including a blade seal, attached to the ceiling of said cart, forming a thermal seal with the topmost of said support/barrier sections or food service trays;

a floor seal having a structure corresponding to the top portion of said support/barrier sections forming a thermal seal with the lowermost of said blade seals or food service trays;

a door seal strip extending from the top of the cart door to the bottom of said cart door, opposite said thermal curtain when the cart door is closed, said door seal strip having a cross-sectional shape corresponding to the front edge of said plurality of support/barrier sections and blade seals; and said tray support/barrier sections and said blade seals formed of a thermally insulating material.

* * * * *